US005288127A

United States Patent [19]

Berg et al.

[11] Patent Number: 5,288,127

[45] Date of Patent: Feb. 22, 1994

[54] ROCKING SEAT

[76] Inventors: Joseph A. Berg, 5353 Topanga Canyon Blvd., No. 310, Woodland Hills, Calif. 91364; Thomas E. Violand, Jr., 7660 Alabama Ave., Canoga Park, Calif. 91304

[21] Appl. No.: 5,351

[22] Filed: Jan. 19, 1993

[51] Int. Cl.[5] ..... A47C 1/02

[52] U.S. Cl. ..... 297/312; 297/302; 297/313; 248/560

[58] Field of Search ..... 297/201, 302, 312, 313, 297/258; 248/560, 632

[56] References Cited

U.S. PATENT DOCUMENTS

| | | | |
|---|---|---|---|
| 582,144 | 5/1897 | Moore | 297/312 |
| 2,482,996 | 9/1949 | Wisby | 297/312 |
| 2,799,323 | 7/1957 | Berg . | |
| 3,080,195 | 3/1963 | Berg . | |
| 3,749,442 | 7/1973 | Berg et al. . | |
| 4,047,757 | 9/1977 | Berg et al. . | |
| 4,889,385 | 12/1989 | Chadwick et al. | 297/302 |
| 5,024,485 | 6/1991 | Berg et al. | 297/312 |

*Primary Examiner*—Peter R. Brown

*Attorney, Agent, or Firm*—Thomas I. Rozsa; Tony D. Chen

[57] ABSTRACT

An improvement to a seat having relatively adjustable sections to improve the rocking means of each separate seat section to move back and forth in a longitudinal rocking, move downwardly and sliding backwardly, to thereby more effectively and efficiently assist in the comfort of the individual. The improvement includes a seat rocking member such as an arch shaped suspension affixed to the lower portion of each seat half and affixed at only one side to the upper surface of the base. The resilience of the arch shaped suspensions permits and limits the seat to move downwardly and slide backwardly, when a force such as the weight of a person pushes downwardly on the seat. The resilience of the arch shaped suspensions further permits and limits the seat to rock back and forth to thereby enable the user to independently rock back and forth in a front to back rocking arrangement on each seat half.

25 Claims, 3 Drawing Sheets

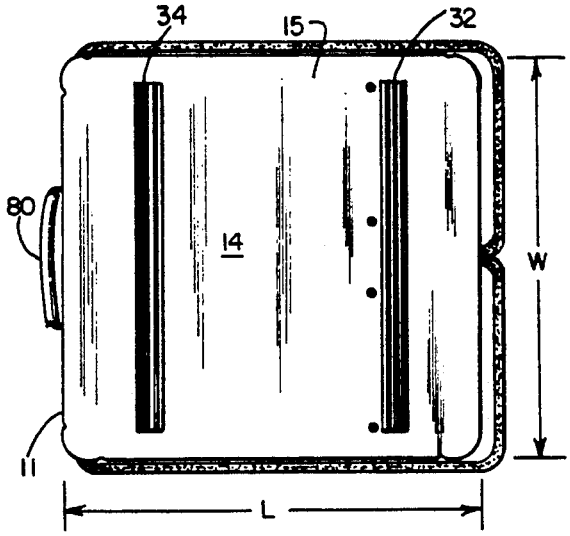
Fig. 5.
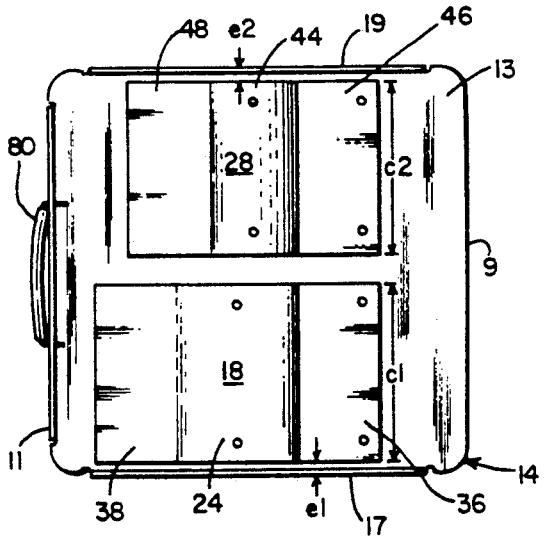
Fig. 6.
Fig. 7.
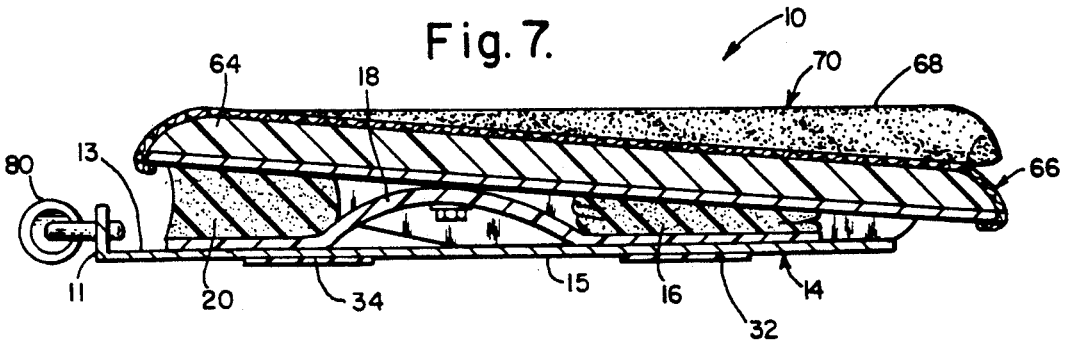

ROCKING SEAT

BACKGROUND OF THE INVENTION

1. Field of the Invention

The present invention relates to an improved rocking seat design and construction. In particular, the present invention relates to therapeutic seat design and constructions.

2. Description of the Prior Art

In general, posture chairs and various seat configurations used as an integral part of the posture chair are known in the prior art. One of the inventors of the present invention is Joseph A. Berg and is a pioneer in having developed and patented several seating arrangements which have helped to provide greater comfort to individuals as they sit on a seat. The following patents have been issued to either inventor Joseph A. Berg individually or to co-inventors Joseph A. Berg and Loren W. Eames.

1. U.S. Pat. No. 2,799,323 issued Joseph A. Berg on Jul. 16, 1957 for "Self-Aligning Seat Construction" (hereafter "the '323 Patent").

2. U.S. Pat. No. 3,080,195 issued Joseph A. Berg on Mar. 5, 1963 for "Self-Aligning Seat Construction" (hereafter "the '195 Patent").

3. U.S. Pat. No. 3,749,442 issued Joseph A. Berg and Loren W. Eames on Jul. 31, 1973 for "Seat Having Relatively Adjustable Sections" (hereafter "the '442 Patent").

4. U.S. Pat. No. 4,047,757 issued Joseph A. Berg and Loren W. Eames on Sep. 13, 1977 for "Seating Structures With Flexible Backs" (hereafter "the '757 Patent").

5. U.S. Pat. No. 5,024,485 issued Joseph A. Berg and Loren W. Eames on Jun. 18, 1991 for "Front And Back Adjustable Rocking Seat Support Arrangement For Seat Having Relatively Adjustable Sections" (hereafter "the '485 Patent").

In each of these Patents, the object was to provide a seat construction which readily responded to or accommodated itself to the position of the body of the person occupying it. The object was to provide a seat which was self-aligning and which was so constructed that it allowed each side of the body of the occupant of the seat to move normally and independently of the other without restraint.

The '323 Patent discloses a seat having two separate halves. Each half is supported independently by coil spring members mounted between the seat half and the base plate.

The '195 Patent discloses an improvement over the '323 Patent. The seat disclosed in the '195 Patent also includes two separate independent halves. Each half is supported by a resilient cushioning pad placed underneath the seat half.

The '757 Patent discloses a seat unit having a flexible seat back. The seat back is separated into two halves to support a user's back at opposite sides of the user's spine.

The '422 Patent discloses an improvement over the '323 Patent and the '195 Patent. Each seat half of the '422 Patent is supported by a universal joint support which allows the seat half to be rocked. Each seat half further comprises a localized recess offset rearwardly from the universal joint for receiving the ischial tuberosity bones of the user of the seat.

The '485 Patent discloses an improvement over the '442 Patent. The improvement of the '485 Patent comprises a seat rocking means such as a cylindrical rod affixed to the lower portion of each seat half and a pair of spaced apart resilient receiving means for each seat half to movably and rotatably support a seat half on the base of the seat. The improvement restricts the movement of each separate seat section to move only back and forth in a longitudinal rocking motion as compared to the universal movement of the '442 Patent.

The seat having adjustable sections as disclosed and claimed in the '485 Patent had many beneficial effects. However, one disadvantage of the '485 Patent is that it has too many mechanical moving components and it is therefore too expensive to manufacture. Another disadvantage of the '485 Patent is that an adjustable device has to be used to limit the amount of front rocking motion. The adjustable device was created for that purpose only and it adds additional mechanical requirements. Therefore, to correct this problem with the seating arrangement disclosed in the '485 Patent, it is necessary to eliminate the adjustable device and also to reduce the mechanical components on the seating arrangement. Another purpose is to reduce the cost in manufacturing the seating arrangement for the consumer sector.

Various other posture seating and seat arrangements are known in the prior art and the following patents are representative of such arrangements:

1. U.S. Pat. No. 633,087 issued to Johnson on Sep. 12, 1899 for "Chair" (hereafter "the Johnson Patent").

2. U.S. Pat. No. 1,990,661 issued to Middleton on Feb. 12, 1935 for "Vehicle Seat" (hereafter "the Middleton Patent").

3. U.S. Pat. No. 3,393,941 issued to Grosfillex on Jul. 23, 1968 for "Article For Seating Furniture" (hereafter "the Grosfillex Patent").

4. U.S. Pat. No. 4,589,699 issued to Dungan on May 20, 1986 for "Sit-Kneel Chair" (hereafter "the Dungan Patent").

5. German Patent Publication No. 35 13 985 A1 published on Oct. 30, 1986 for "Tilting Chair Providing Back Pressure Relief" (hereafter "the German Patent").

The Middleton Patent discloses a vehicle seat and is of interest as being disposed upon a multiplicity of spherical members. However, the spherical members do not have a front and back locking and rocking arrangement.

The Dungan Patent is for the well known sit-kneel chair and discloses a pivotally mounted seat. However, movement is dependant upon a single bolt as opposed to the sphere and pin locking and rocking arrangement.

The Johnson Patent discloses a rocking chair including a seat which may tilt forward and rearward. However, the mechanism which consists of an arc shape support block is different than the present invention arrangement.

The Grosfillex Patent discloses a seat construction. The seat is supported on the leg frame by a pair of front hook devices and a rear clamping device.

Finally, the German Patent discloses a tilting chair of interest with respect to the ball. However, the tilting is performed by a spring and not by a locking and rocking arrangement.

Therefore, there is a need for an improvement on the rocking means of the seat having relatively adjustable sections as disclosed in the '485 Patent which will permit each of the seat halves to move independently of each other but in a modified manner.

SUMMARY OF THE INVENTION

The present invention is an improved rocking seat having two arch shaped suspension members between the upper plates and the lower base plate. The two arch suspension members are made of fiberglass.

The present invention is an improvement to the seat having relatively adjustable sections disclosed and claimed in the '485 Patent to restrict the movement of each separate seat section to move back and forth in a longitudinal rocking motion and to eliminate the adjustable device, to thereby more effectively and efficiently assist in the comfort of the individual and adjustment of the seat to movements of the user. The improvement comprises a seat rocking member such as an arch shaped fiberglass suspension affixed to the lower portion of each seat half to movably and rotatably support a seat half on the base of the seat. The two arch shaped suspension members permit and limit the seat rocking members to move downwardly and sliding backwardly when a force such as the weight of a person pushes downwardly on the seat. The arch suspensions further permit and limit the seat rocking means to rock back and forth to thereby enable the user to independently rock back and forth in a front to back rocking arrangement on each seat half.

It has been discovered, according to the present invention, that use of an arch shaped suspension means permits and limits each seat half to be rocked independently of the other half in the front to back rocking arrangement and also a backward sliding movement, which provides a seat which is an improvement over the seat described in the '485 Patent in that this arch shaped suspension reduces the mechanical components used in the seating arrangement.

It is therefore an object of the present invention to provide an improvement in the seat disclosed in the '485 Patent wherein the improvement reduces the mechanical components used in the seating arrangement.

It is a further object of the present invention to provide a seat which can have the extent of the rocking of each seat half specifically adjusted to conform to the wishes of the individual users.

It is another object of the present invention to provide a seat assembly which is specifically designed to support the weight of a person with greater comfort than in conventional chairs, and to do so in a manner attaining automatic accommodation of the seat surfaces to slight movements of the user, with the seat divided into two half sections so that each side can individually move to accommodate the specific body of the user.

It is an additional object of the present invention to provide a seat which can adjust itself to the specific contours of the user through each half of the seat separately rocking back and forth with the rocking only in the longitudinal direction and move downwardly and sliding backwardly movement and in so doing helps to realign the body of the user through slight balancing of the hip and spine.

It is also an object of the present invention to make the seat portable, so that it can be carried to any multiplicity of locations such as to sporting events, picnics, etc.

It is a further object of the present invention to make the seat affordable for the consumer sector.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 5 is a bottom view of the present invention rocking seat with two rubber strips attached to the bottom surface for preventing the base from moving.

FIG. 6 is a plan view of the seat body, disclosing the arch shaped suspension members with one of the arch shaped suspension shown in a sliding backward movement.

FIG. 7 is a cross-sectional view of the seat base, a rocking seat half, and the rocking forward movement.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
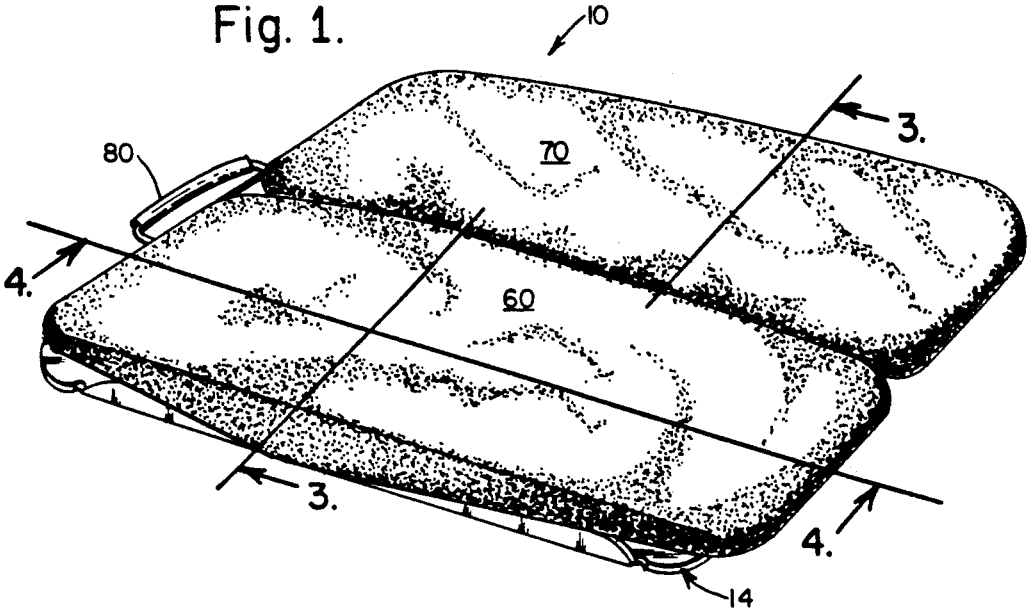
FIG. 1 is a perspective view of the present invention rocking seat.
Figure 2:
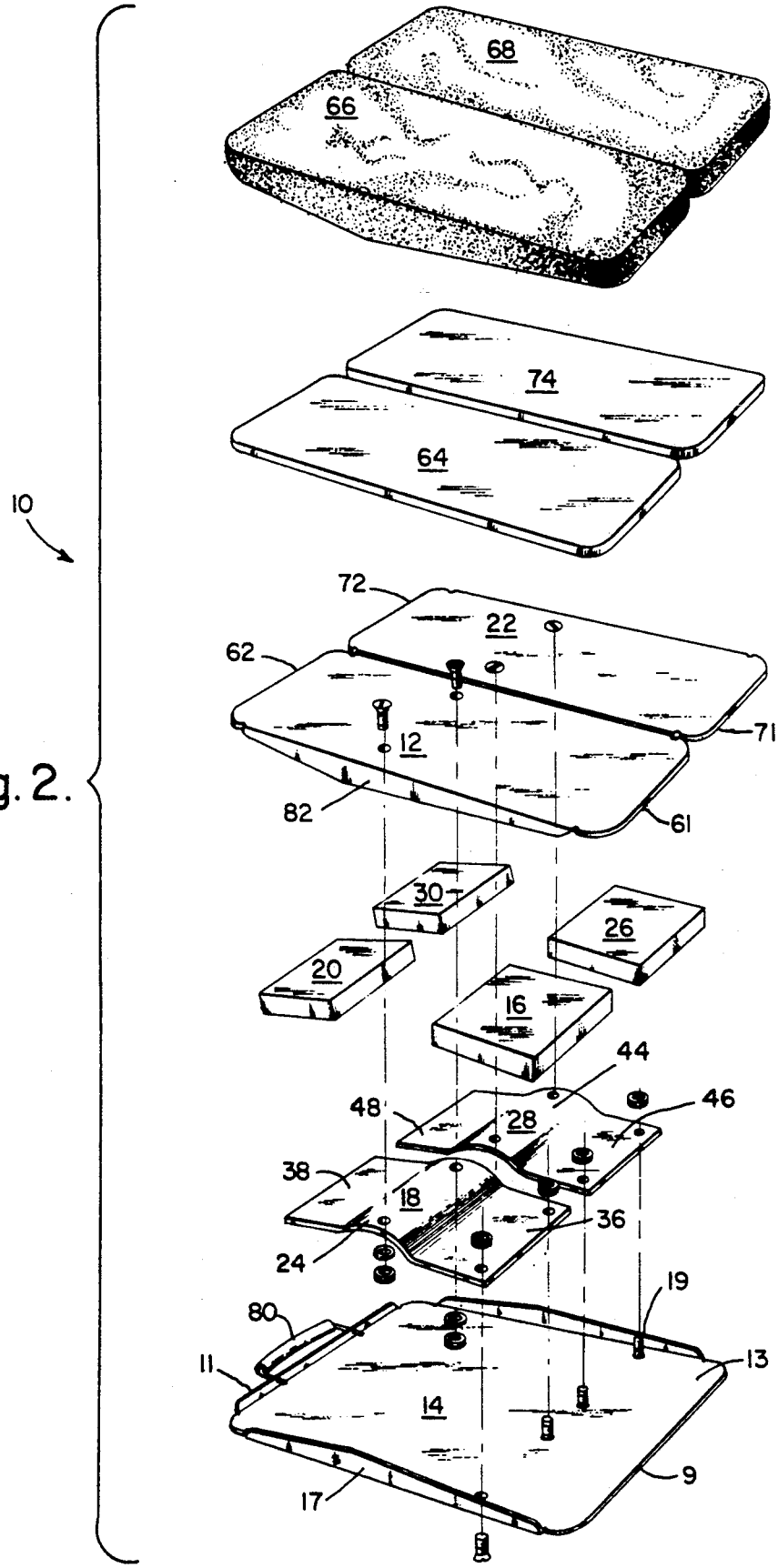
FIG. 2 is an exploded view of the present invention rocking seat.

Referring to FIGS. 1 and 2, there is shown at 10 the seat assembly which includes two seat bodies 12 and 22 to which two complementary seat cushion assemblies 60 and 70 are mounted respectively for limited individual adjustable rocking movement. The seat assembly 10 further comprises a rigid base 14 and a pair of spaced apart resilient arch shaped suspensions 18 and 28. Each arch shaped suspension is preferably made out of fiberglass material. First arch shaped suspension 18 comprises an upper section 24 and two lower sections 36 and 38, where only the first lower section 36 is attached to the upper surface 13 of the rigid base 14 and located adjacent to the front end 9 of the rigid base 14. The second lower section 38 of the arch shaped suspension 18 can move in a horizontal plane by sliding on the upper surface 13 of the rigid base 14. Similarly, the second arch shaped suspension 28 comprises an upper section 44 and two lower sections 46 and 48, where the first lower section 46 is attached to the upper surface 13 of the rigid base 14 and located adjacent to the front end 9 of the rigid base 14. The second lower section 48 of the arch shaped suspension 28 can move in a horizontal plane by sliding on the upper surface 13 of the rigid base 14. Each arch shaped suspension member permits and limits the seat rocking member to move downwardly and slide backwardly, when a force such as the weight of a person pushes downwardly on the seat. Each arch shaped suspension further permits and limits the seat rocking member to rock back and forth to thereby enable the user to independently rock back and forth in a front to back rocking arrangement on each seat half.

Figure 3:
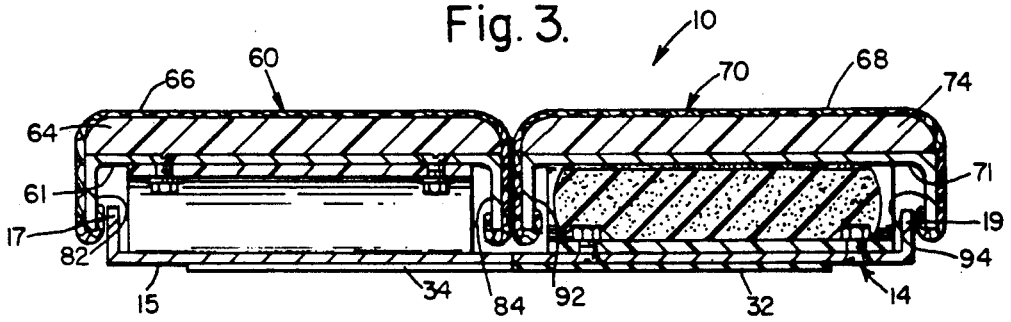
FIG. 3 is a cross-sectional view of the present rocking seat, taken along line 3—3 of FIG. 1.

Referring to FIGS. 3 though 6, the rigid base 14 preferably takes the form of a flat or planar sheet of material. The side edges 17 and 19 of the base 14 each comprises an upward flange for stabilizing the rigid base 14. The rear edge 11 of the rigid base 14 also comprises an upward flange for stabilizing the base 14 in which a handle member 80 is attached to the upward flange. Two elongated rubber strips 32 and 34 are attached to the lower surface 15 of base 14 for preventing the base 14 from sliding on or moving around on the chair. By way of example, the overall length "L" and width "W" of base 14 are approximately 14.625 inches and 14.00 inches respectively. Given these dimensions, in the preferred embodiment the distance "d1" from the upper section mounting holes of the resilient arch shaped suspensions to the front edge 9 of base 14 is approximately 7.625 inches while the distance "d2" from the upper section mounting holes of the resilient arch shaped suspensions to the rear edge 11 of the base 14 is approximately 7.00 inches. The width "c1" of the first arch shaped suspension 18 is approximately 6.25 inches. Similarly, the width "c2" of the second arch shaped suspension 28 is also approximately 6.25 inches. The resilient arch shaped suspension members 18 and 28 are each set in from respective side edges 17 and 19 of base 14 by a distance of "e1" and "e2" respectively of approximately 0.25 inch. It will be appreciated that these dimensions are merely one illustrative embodiment and can include many other comparable sets of dimensions. For portability, base 14 may be made of sheet metal or comparable strong lightweight material.

Figure 4:
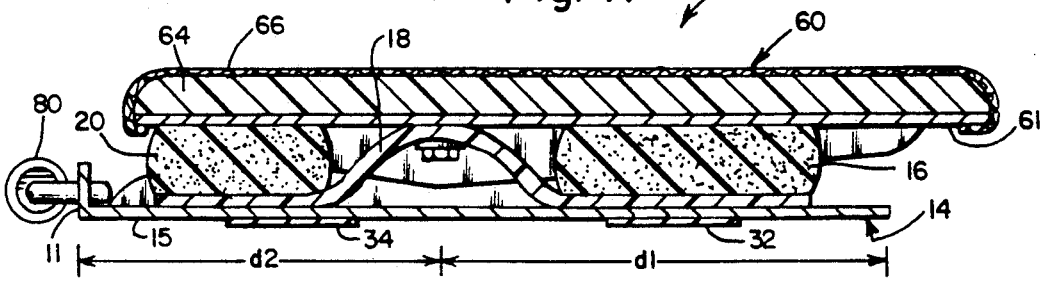
FIG. 4 is a cross-sectional view of the present invention rocking seat, taken along line 4—4 of FIG. 1.

Referring to FIGS. 2, 3 and 4, the seat portion including the seat cover and neoprene cushioning material of each seat cushion assembly may also be contoured with various curves and other configurations as described in the '485 Patent and the '442 Patent to receive the ischial tuberosity bones of the user.

The seat assembly comprises a pair of seat cushion assemblies 60 and 70 which extend over the top surface of the two seat bodies 12 and 22. First seat cushion assembly 60 comprises a generally flat cushion base 62, and a neoprene cushion material section 64 which is attached to the upper surface of the flat cushion base 62. The seat base 62 comprises two downwardly flanged edges 82 and 84 for stabilizing the seat body 12. Affixed to the lower surface 61 of the seat base 62 is a pair of spaced apart resilient spacer members, including a front spacer member 16 and a rear spacer member 20. Each spacer member is preferably made out of resilient cushioning material such as foam rubber. Set between the pair of spacer members 16 and 20 is the upper section 24 of the arch shaped suspension 18. The upper section 24 of the arch shaped suspension 18 is attached firmly to the lower surface 61 of the flat cushion base 62. Similarly, the second seat cushion assembly 70 comprises a generally flat cushion base 72, and a neoprene cushioning material section 74 which is attached to the upper surface of the cushion base 72. The seat base 72 comprises two downward flange edges 92 and 94 for stabilizing the seat body 22. Affixed to the lower surface 71 of the seat base 72 is a pair of spaced apart resilient spacer members, including a front spacer member 26 and a rear spacer member 30. Each spacer member is preferably made out of resilient cushioning material such as foam rubber. Set between the pair of spacer members 26 and 30 is the upper section 44 of the arch shaped suspension 28. The upper section 44 of the arch shaped suspension 28 is attached firmly to the lower surface 71 of the flat cushion base 72. The seat cushion assemblies 60 and 70 are wrapped by two pieces of cloth material 66 and 68 respectively.

In operation, when a downward force is exerted on the seat cushion assemblies 60 and 70 such as a person sitting on the seat cushions, the unattached second lower sections 38 and 48 of the resilient arch shaped suspensions 18 and 28 move in a sliding backward movement which causes the upper sections 24 and 44 to move downwardly, thereby providing the user with a feeling of resilience and comfort to show that the seat has some give and play.

Referring to FIG. 7, the forward rocking movement is illustrated. Each seat cushion assembly can rock front to back with its respective arch shaped suspension. The nature of the arch shaped suspensions prevents each seat cushion means from lateral rocking from side to side since each seat rocking means has an arch shaped suspension firmly attached to the upper surface 13 of base 14 and each respective lower surface of the flat cushion bases, thereby preventing side to side or lateral rocking. Since first seat cushion assembly 60 is independent of second seat cushion assembly 70, each seat cushion assembly can rock front to back independently of the other, thereby enabling the user to completely position his body into the seat at any desired comfort level.

Defined in detail, the present invention is a seat comprising:

a. a body further comprising, (i) a base having an upper surface, a lower surface, a front edge, a rear edge having an upward flange, and two side edges each having an upward flange, (ii) a first arch shaped suspension and a second arch shaped suspension, each having an upper section, a first lower section and a second lower section, (iii) means for attaching said first lower section of said first arch shaped suspension to said upper surface of said base at a first location adjacent to said front edge of said base, such that said first arch shaped suspension is parallel and adjacent to said first side edge of said base, (iv) means for attaching said first lower section of said second arch shaped suspension to said upper surface of said base at a second location adjacent to said front edge of said base, such that said second arch shaped suspension is parallel and adjacent to said second side edge of said base, (v) a handle member attached to said upward flange of said rear edge of said base for carrying said seat;

b. a first seat cushion assembly further comprising, (i) a first cushion base having an upper surface, a lower surface and two downward side flanges, (ii) a first cushioning material attached to said upper surface of said cushion base, (iii) a first cover protecting said first cushioning material and said first cushion base, (iv) a first pair of spaced apart resilient spacer members affixed to said lower surface of said first cushion base, including a front spacer member and a rear spacer member, (v) means for attaching said upper section of said first arch shaped suspension to said lower surface of said first cushion base between said first pair of spacer members, said first arch shaped suspension being resilient, so that said first seat cushion assembly can move downwardly as said second lower section of said first arch shaped suspension slides backwardly, when a force such as a weight of a person pushes downwardly on said first seat cushion assembly, said first arch shaped suspension further permitting said first seat cushion assembly to rock back and forth;

c. a second seat cushion assembly further comprising, (i) a second cushion base having an upper surface, a lower surface and two downward side flanges, (ii) a second cushioning material attached to said upper surface of said second cushion base, (iii) a second cover protecting said second cushioning material and said second cushion base, (iv) a second pair of spaced apart resilient spacer members affixed to said lower surface of said second cushion base, including a front spacer member and a rear spacer member, (v) means for attaching said upper section of said second arch shaped suspension to said lower surface of said second cushion base between said second pair of spacer members, said second shaped arch suspension being resilient, so that said second seat cushion assembly can move downwardly as said second lower section of said second arch shaped suspension slides backwardly, when a force such as a weight of a person pushes downwardly on said second seat cushion assembly, said second arch shaped suspension further permitting said second seat cushion assembly to rock back and forth; and d. said first seat cushion assembly and said second seat cushion assembly positioned adjacent one another but spaced by a distance to permit each seat cushion assembly to rock back and forth independently of each other;

e. whereby said each seat cushion assembly can independently move downwardly and sliding backwardly and rock back and forth, and the rocking on said base is cushioned by said first and second pairs of spacer members.

Defined broadly, the present invention is a seat comprising:

a. a body further comprising, (i) a base having an upper surface, a lower surface, a front, a rear and two longitudinal sides, (ii) a pair of arch suspensions, each having a top section, a front lower section and a rear lower section, (iii) means for attaching said respective front lower sections of said pair of arch suspensions to said upper surface of said base at locations adjacent to said front of said base, such that said pair of arch suspensions are spaced apart and parallel to said longitudinal sides;

b. a pair of spaced apart longitudinal seat cushion assemblies, each seat cushion assembly further comprising, (i) a lower surface, (ii) a pair of spaced apart resilient spacer members affixed to said lower surface, (iii) means for attaching said top section of a respective one of said pair of arch suspensions to said lower surface between said pair of spacer members, said respective one of said pair of arch suspensions being resilient, so that said each seat cushion assembly can move downwardly as said rear surface of said respective one of said pair of arch suspensions slides backwardly, when a force such as a weight of a person pushes downwardly on said each seat cushion assembly, said respective one of said pair arch of suspensions further permitting said each seat cushion assembly to rock back and forth independently; and c. whereby said each seat cushion assembly can independently move downwardly and sliding backwardly and rock back and forth, and the rocking on said base is cushioned by said spacer members.

Defined more broadly, the present invention is a seat comprising: (a) a base having an upper surface, a lower surface, a first end, a second end and two opposite sides; (b) a pair of resilient suspension members each having a straight first end section, a second straight end section and an arch shaped middle section; (c) means for attaching said respective first straight end sections of said pair of resilient suspension members to said upper surface of said base at respective locations adjacent to said first end of said base, such that said pair of resilient suspension members are spaced apart and parallel to said two opposite sides of said base; (d) a pair of half-seat assemblies each having an upper seating surface and a lower surface; and (e) means for attaching said respective arch shaped middle sections of said pair of resilient suspension members to said lower surfaces of a respective one of said pair of half-seat assemblies, such that said pair of half-seat assemblies are spaced apart and parallel to said two opposite sides of said base; (f) whereby when a user sits on said seat, each one of said pair of half-seat assemblies can independently move downwardly and slide backwardly and rock back and forth.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the board features or principles of the present invention, or the scope of patent monopoly to be granted.

What is claimed is:

1. A seat comprising:

a. a body further comprising, (i) a base having an upper surface, a lower surface, a front edge, a rear edge having an upward flange, and two side edges each having an upward flange, (ii) a first arch shaped suspension and a second arch shaped suspension, each having an upper section, a first lower section and a second lower section, (iii) means for attaching said first lower section of said first arch shaped suspension to said upper surface of said base at a first location adjacent to said front edge of said base, such that first arch shaped suspension is parallel and adjacent to said first side edge of said base, (iv) means for attaching said first lower section of said second arch shaped suspension to said upper surface of said base at a second location adjacent to said front edge of said base, such that said second arch shaped suspension is parallel and adjacent to said second edge of said base, (v) a handle member attached to said upward flange of said rear edge of said base for carrying said seat;

b. a first seat cushion assembly further comprising, (i) a first cushion base having an upper surface, a lower surface and two downward side flanges, (ii) a first cushioning material attached to said upper surface of said cushion base, (iii) a first cover protecting said first cushioning material and said first cushion base, (iv) a first pair of spaced apart resilient spacer members affixed to said lower surface of said first cushion base, including a front spacer member and a rear spacer member, (v) means for attaching said upper section of said first arch shaped suspension to said lower surface of said first cushion base between said first pair of spacer members, said first arch shaped suspension being resilient, so that said first seat cushion assembly can be move downwardly as said second lower section of said first arch shaped suspension slides backwardly, when a force such as a weight of a person pushes downwardly on said first seat cushion assembly, said first arch shaped suspension further permitting said first seat cushion assembly to rock back and forth;

c. a second seat cushion assembly further comprising, (i) a second base having an upper surface, a lower surface and two downward side flanges, (ii) a second cushioning material attached to said upper surface of said second cushion base, (iii) a second cover protecting said second cushioning material and said second cushion base, (iv) a second pair of spaced apart resilient spacer members affixed to said lower surface of said second cushion base, including a front spacer member and a rear spacer member, (v) means for attaching said upper section of said second arch shaped suspension to said lower surface of said second cushion base between said second pair of spacer members, said second shaped arch suspension being resilient, so that said second seat cushion assembly can move downwardly as said second lower section of said second arch shaped suspension slides backwardly, when a force such as a weight of a person pushes downwardly on said second seat cushion assembly, said second arch shaped suspension further permitting said second seat cushion assembly to rock back and forth; and d. said first seat cushion assembly and said second seat cushion assembly positioned adjacent one another but spaced by a distance to permit each seat cushion assembly to rock back and forth independently of each other;

e. whereby said each seat cushion assembly can independently move downwardly and sliding backwardly and rock back and forth, and the rocking on said base is cushioned by said first and second pairs of spacer members.

2. The invention as defined in claim 1 wherein said base and said first and second cushion bases are made of sheet metal.

3. The invention as defined in claim 1 wherein said first and second pairs of spacer members of said first and second seat cushion assemblies are made of foam rubber.

4. The invention as defined in claim 1 wherein said first and second cushion materials of said first and second seat cushion assemblies are made of neoprene material.

5. The invention as defined in claim 1 wherein said first and second arch shaped suspensions are made of fiberglass.

6. The invention as defined in claim 1 wherein said handle member is made of plastic.

7. The invention as defined in claim 1 wherein said first and second cover are made of cloth material.

8. The invention as defined in claim 1 further comprising a pair of elongated rubber strips attached to said lower surface of said base for preventing said base from sliding.

9. The invention as defined in claim 1 wherein said seat is portable.

10. A seat comprising:

a. a body further comprising, (i) a base having an upper surface, a lower surface, a front, a rear and two longitudinal sides, (ii) a pair of arch suspensions, each having a top section, a front lower section and a rear lower section, (iii) means for attaching said respective front lower sections of said pair of arch suspensions to said upper surface of said base at locations adjacent to said front of said base, such that said pair of arch suspensions are spaced apart and parallel to said two longitudinal sides, b. a pair of spaced apart longitudinal seat cushion assemblies, each seat cushion assembly further comprising, (i) a lower surface, (ii) a pair of spaced apart resilient spacer members affixed to said lower surface, (iii) means for attaching said top section of a respective one of said pair of arch suspensions to said lower surface between said pair of spacer members, said respective one of said pair of arch suspensions being resilient, so that said each seat cushion assembly can move downwardly as said rear surface of said respective one of said pair of arch suspensions slides backwardly, when a force such as a weight of a person pushes downwardly on said each seat cushion assembly, said respective one of said pair arch of suspensions further permitting said each seat cushion assembly to rock back and forth independently; and c. whereby said each seat cushion assembly can independently move downwardly and sliding backwardly and rock back and forth, and the rocking on said base is cushioned by said spacer members.

11. The invention as defined in claim 10 wherein said base is made of sheet metal.

12. The invention as defined in claim 10 wherein said pair of spacer members of said each seat cushion assembly is made of foam rubber.

13. The invention as defined in claim 10 wherein said pair of arch suspensions are made of fiberglass.

14. The invention as defined in claim 10 further comprising a pair of elongated rubber strips attached to said lower surface of said base for preventing said base from sliding.

15. The invention as defined in claim 10 wherein said base has an upward flange for stabilizing said base at each of its said two longitudinal sides and said rear.

16. The invention as defined in claim 10 further comprising a handle member attached to said rear of said base.

17. The invention as defined in claim 16 wherein said handle member is made of plastic.

18. A seat comprising:

a. a base having an upper surface, a lower surface, a first end, a second end and two opposite sides;

b. a pair of resilient suspension members each having a first straight end section, a second straight end section and an arch shaped middle section;

c. means for attaching said respective first straight end sections of said pair of resilient suspension members to said upper surface of said base at respective locations adjacent to said first end of said base, such that said pair of resilient suspension members are spaced apart and parallel to said two opposite sides of said base;

d. a pair of half-seat assemblies each having an upper seating surface and a lower surface; and e. means for attaching said respective arch shaped middle sections of said pair of resilient suspension members to said lower surfaces of a respective one of said pair of half-seat assemblies, such that said pair of half-seat assemblies are spaced apart and parallel to said two opposite sides of said base;

f. whereby when a user sits on said seat, each one of said pair of half-seat assemblies can independently move downwardly and slide backwardly and rock back and forth.

19. The invention as defined in claim 18 wherein said base is made of sheet metal.

20. The invention as defined in claim 18 wherein said pair of resilient suspension members are made of fiberglass.

21. The invention as defined in claim 18 further comprising a pair of elongated rubber strips attached to said lower surface of said base for preventing said base from sliding.

22. The invention as defined in claim 18 wherein said base has an upward flange for stabilizing said base at each of its said two opposite sides and said second end.

23. The invention as defined in claim 18 further comprising a handle member attached to said second end of said base.

24. The invention as defined in claim 23 wherein said handle member is made of plastic.

25. The invention as defined in claim 18 wherein said pair of half-seat assemblies each having a cushioning material affixed to each said upper surface of said pair of half-seat assemblies, a cover protecting each of the cushioning material and a pair of spaced apart resilient spacer members affixed to each said lower surface of said pair of half-seat assemblies.

* * * * *